US005681109A

United States Patent [19]

Palmer

[11] Patent Number: 5,681,109

[45] Date of Patent: Oct. 28, 1997

[54] APPARATUS AND METHOD FOR ADDING A POWDEROUS SUBSTANCE TO A LIQUID

[76] Inventor: Phillip M. Palmer, 234 N. 500 West, Richfield, Utah 84701

[21] Appl. No.: 598,981

[22] Filed: Feb. 9, 1996

[51] Int. Cl.[6] ..... B01F 3/12; B01F 15/02

[52] U.S. Cl. ..... 366/167.1; 366/174.1; 366/184; 422/274; 422/278

[58] Field of Search ..... 366/137.1, 167.1, 366/167.2, 174.1, 175.2, 181.2, 181.1, 183.2, 183.1, 184, 150.1; 222/189.06; 422/261, 264, 274, 275, 276, 277, 278; 239/222.17, 222.15, 222.11

[56] References Cited

U.S. PATENT DOCUMENTS

| | | | |
|---|---|---|---|
| 1,774,960 | 9/1930 | Bowman | 422/274 |
| 1,931,527 | 10/1933 | Burkett et al. | 422/274 |
| 3,312,400 | 4/1967 | Clearman | 239/222.17 |
| 3,595,438 | 7/1971 | Daley | 422/274 |
| 3,653,639 | 4/1972 | Mueller | 366/167.1 |
| 4,816,222 | 3/1989 | Fagrell | 422/275 |
| 4,999,124 | 3/1991 | Copeland | 222/189.06 |
| 5,229,084 | 7/1993 | Livingston et al. | 422/274 |
| 5,259,409 | 11/1993 | Cervola | 422/264 |
| 5,384,102 | 1/1995 | Ferguson et al. | 422/274 |
| 5,427,748 | 6/1995 | Wiedrich et al. | 422/274 |

FOREIGN PATENT DOCUMENTS

| | | | |
|---|---|---|---|
| 190627 | 7/1957 | Austria | 366/167.1 |

*Primary Examiner*—Tony G. Soohoo
*Attorney, Agent, or Firm*—M. Ralph Shaffer P.C.

[57] ABSTRACT

Apparatus and method for hydraulically adding a powderous substance to a liquid such as a water system, wherein the substance container is provided with a screened lower zone supplied with a liquid sprinkler device, the device being useful to spray liquid on the interior surface of the screen provided for essentially dissolving the powderous particulates which are present at and pass through the screen or filter provided.

4 Claims, 7 Drawing Sheets

APPARATUS AND METHOD FOR ADDING A POWDEROUS SUBSTANCE TO A LIQUID

FIELD OF INVENTION

The present invention pertains to a new and improved apparatus and method for hydraulically adding a powderous substance to a liquid such as a water system, whereby the substance, e.g. finely powdered gypsum, can be introduced into, e.g. a water stream and form a slurry without the disadvantages that. otherwise would be present were an agitation system used.

DESCRIPTION OF PRIOR ART

Much patent literature has been developed in connection with the present field of invention, and of which the following U.S. patents are representative. Their detailed study is invited:

| | | |
|---|---|---|
| 5462352 | 4820053 | 3240476 |
| 5458414 | 4812045 | 3233874 |
| 5447369 | 4599004 | 2908111 |
| 5439020 | 4616579 | 2760820 |
| 5417491 | 4415267 | 2756544 |
| 5340213 | 4397561 | 2751335 |
| 5361711 | 3777003 | 2626482 |
| 5332312 | 3607105 | 2613922 |
| 5240326 | 3570508 | 1992261 |
| 5234268 | 3282468 | |

Singled out from the above list as being special interest are the two patents issued to Rivers patent numbers '045 and '053 and also the patent issued to Hornung et al., '491 .

The Rivers' patents teach a continuous process and apparatus, e.g., "for preparing a gypsum slurry of water and finely divided high purity gypsum for use in an irrigation system." In the Rivers '045 patent, the gypsum and water are mixed by vigorous mechanical agitation, with the structure being provided to create "a quiescent zone in the tank. . .". The situation here is that one does not want the agitation of the slurry mixed within the tank to interfere with an even discharge of slurry from the tank. Rivers '053 discloses, in similar vein, a series of agitators providing for creating a quiescent zone within the tank of particular area so that the agitation does not interfere with slurry production and the even discharge thereof from the tank into the irrigation system being accommodated.

Hornung et al '491 teaches apparatus for injecting controlled amounts of soil amendment including fertilizers into an irrigation system, and does this by first effecting "the batch mixing of a selected soil amendment, in the form of a particulate material in a fluid medium, such that the particulate material is either dissolved or suspended in the fluid medium." The Hornung patent necessarily includes a series of propeller-like agitators for a effecting the slurry mixture.

It would be highly desirous, of course, to provide both apparatus and method for producing a satisfactory, even slurry can be produced without agitation, stirrers and the like, where the mixing can be of a high degree of quality and the slurry mixture produced on a continuous basis.

BRIEF DESCRIPTION OF THE INVENTION

Accordingly, the present invention overcomes the difficulties of prior art structures and methods by supplying a screened bottom zone in the container receiving the powderous substance. The zone is separated from the substance particulates by an apertured or perforate barrier device such as a fine mesh screen or sieve that is, e.g., suitably protected, supported and reenforced. The interior of the zone which is so screened is provided a liquid sprinkler of the so-called "wobbly-sprinkler" type. The sprinkler head employed, thus, is useful in supplying a fine, e. g. watery mist or spray that impinges upon the interior of the fine mesh screen. The spray is sufficient to coact with the finely powdered substance, e.g. soil amendment particulates appearing on the inner surface of the screen of the zone, whereby the powdered amendment immediately becomes suspended and/or dissolved in the water spray, dropping down the resultant slurry fluid to flow through a slurry exhaust conduit. Accordingly, the slurry is hydraulically formed in a highly efficient and uniform manner without the employment of mechanical stirrers, agitators and the like as have been employed in the prior art.

The apparatus and method are particularly useful when the powderous substance constitutes a soil amendment comprising a high purity, powdered, uncalcined gypsum ground such that, e. g., 95% or more passes a 200 mesh screen.

It will be recalled that gypsum consists of hydrated calcium sulfate, is a crystal, and includes a calcium sulfate molecule bound to two water molecules. Gypsum is a highly useful soil amendment for farmland for two reasons; first, it enjoys the property of swelling and filling interstices in the soil, improving the tilth of the soil. Secondly, uncalcined gypsum is highly useful as a sulfate fertilizer feeding arid, alkaline soil. More important, the calcium mixed with irrigation water acts as a flocculating agent to increase soil porosity, water penetration, and efficiency in water use. The water molecules present in the gypsum powder aid not merely in effecting a suspension of the finely divided powder in the water flow, but actually effectuating a dissolving of the powder therein.

Prior agitation and stirring systems have tended to form material globs, in effect, which resist particulate suspension for dissolving in an aqueous medium in the absence of considerable agitation. The present hydraulic method and apparatus, however, avoid these difficulties by simply sweeping powdered gypsum particulates on the fine mesh screen or filter defining the lower zone of the amendment container, and progressively, and by the sprinkler method, absorbing the powdered gypsum in the water thus provided. The same is conducted through an outlet conduit irrigation system, a canal, ditch, or the like. Suitable perforate structures can be substituted for a screen mesh element, as is hereinafter pointed out.

OBJECTS

Accordingly, an object of the present invention is to provide through a sieve and spray-hydraulic technique, a liquid-powderous substance slurry without the employment of agitators, mixers, and the like.

A further object of the invention is to provide a structure having a screened or apertured lower zone suitable for producing a water spray for capturing powdered particulate of a soil amendment, for example as may appear at or proximate the so-screened area of the zone.

Another object is to provide a hydraulic pressure-spray method for providing an amendment slurry which is effectuated without the use of stirrers, agitators or the like, but rather provides, e. g., a water spray capturing technique for introducing a desired amendment into outlet stream flow.

A further object is to provide a contained, with associated structure, for gradually introducing in a water stream flow, a powdered, particulate amendment, this in a manner to produce a slurry that is smooth, and this without agitators.

IN THE DRAWINGS

The present invention, both as to organization and manner of operation, can best understood by reference to the following detailed description, taken in conjunction with the accompanying drawings, in which.

Figure 3:
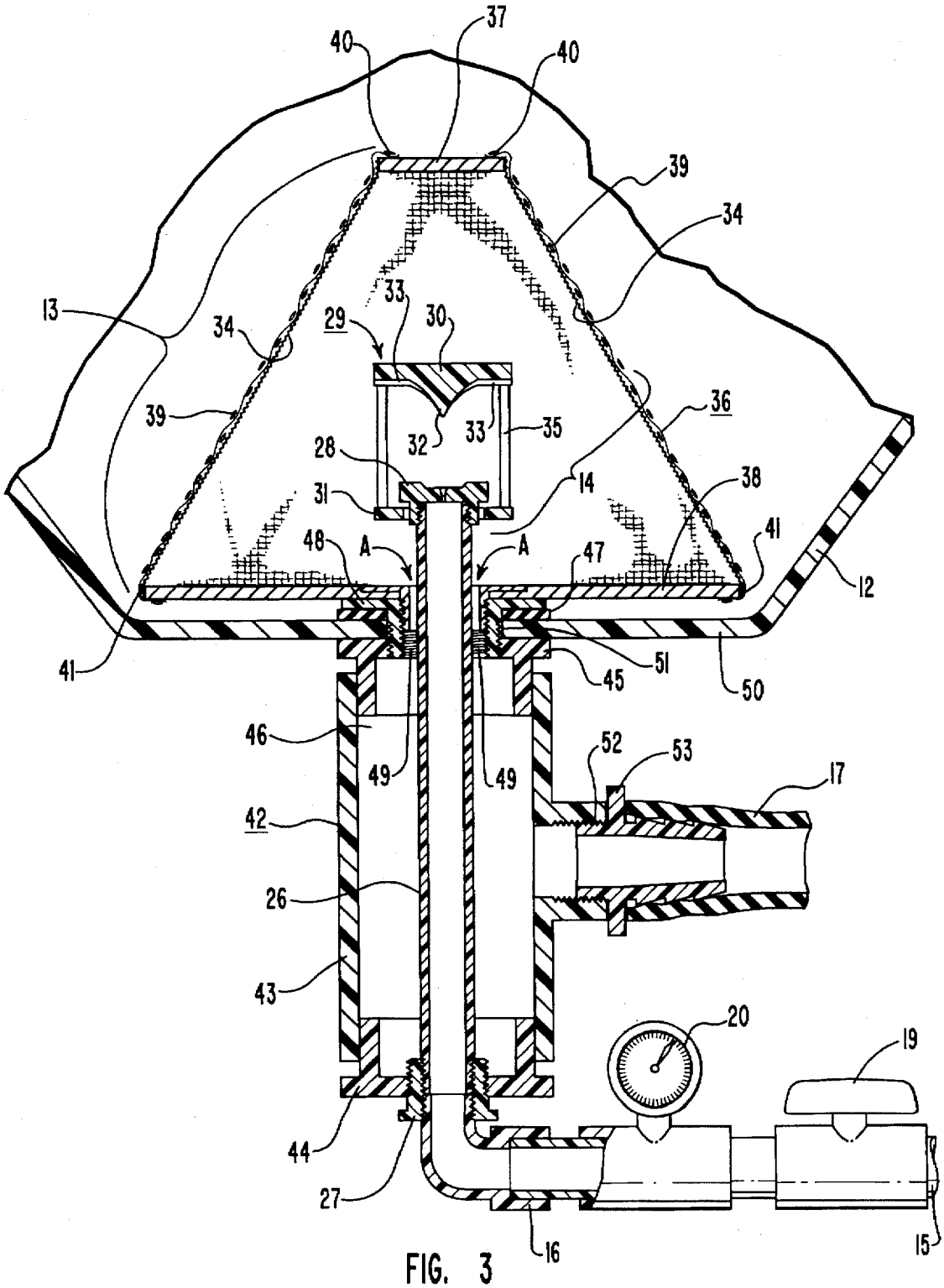
FIG. 3 is an enlarged detail principally in section and taken along the line 3—3 in FIG. 1.
Figure 4:
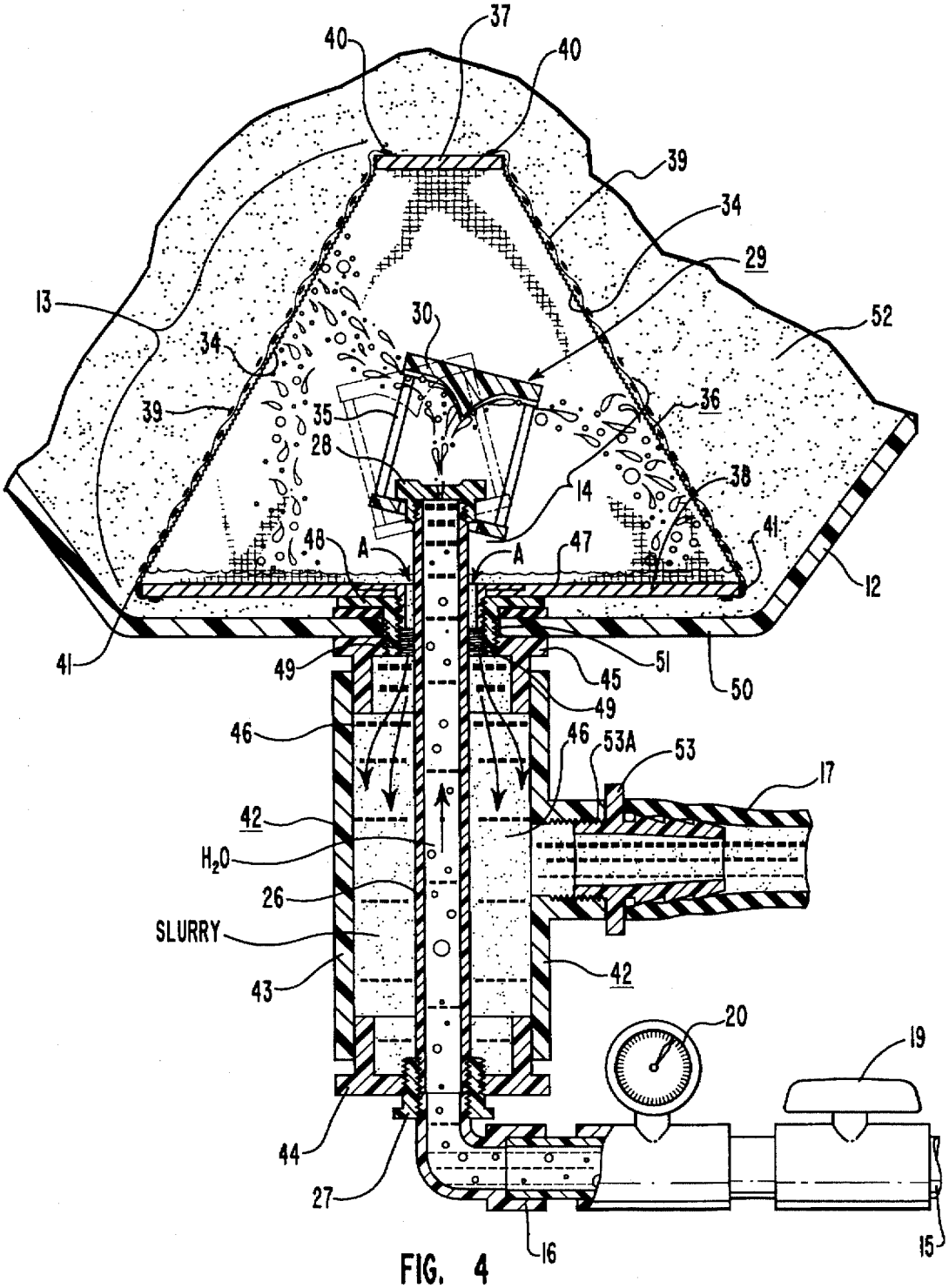
FIG. 4 illustrates the structure in FIG. 3 in an operating condition.
Figure 5:
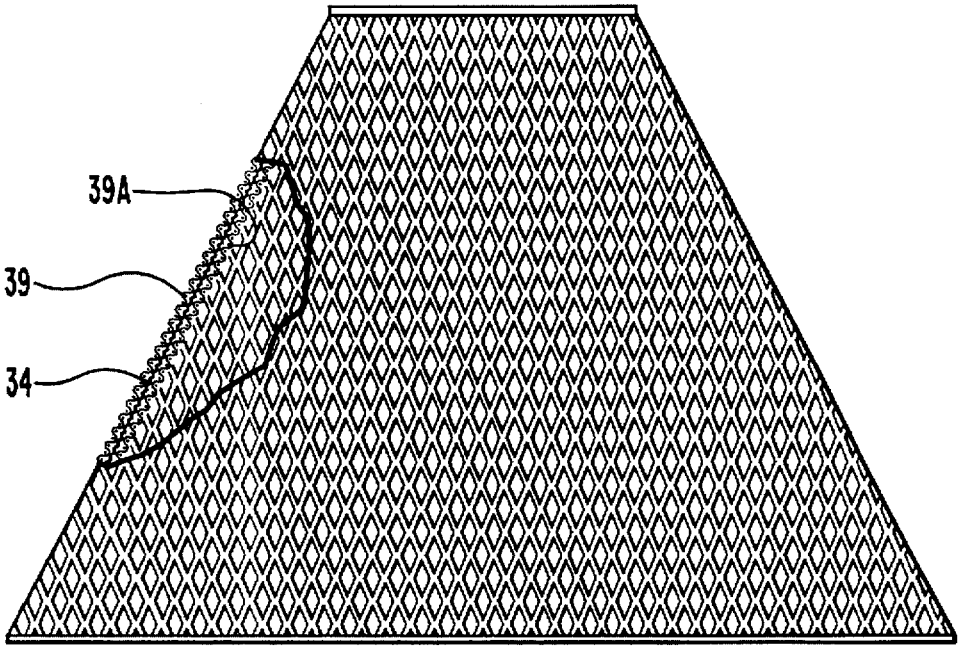
Figure 6:
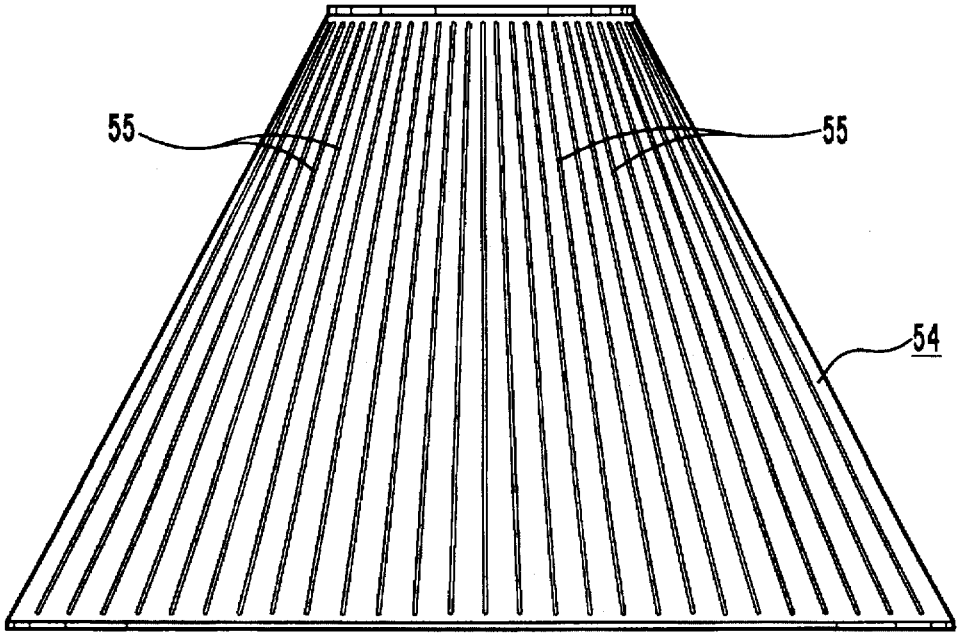
Figure 7:
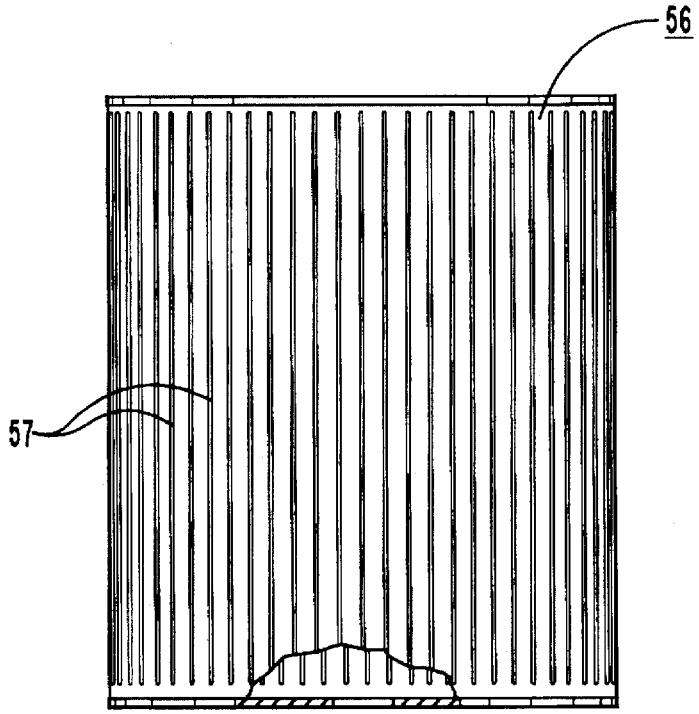

FIGS. 5—7 are respective, fragmentary, front elevation view of respective, alternate structures that can be employed as respective substitutes for the screen structures of FIGS. 3–4.

Figure 8:
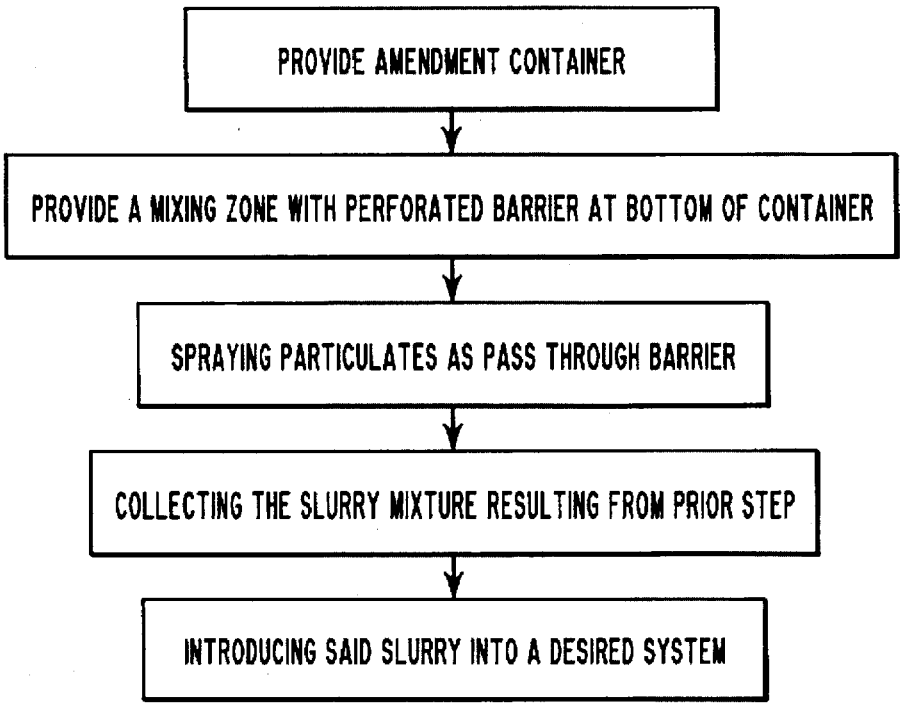

FIG. 8 is a method flow-chart of the hydraulic method inherent in this invention and the disclosed structure thereof, by way of example.

Figure 9:
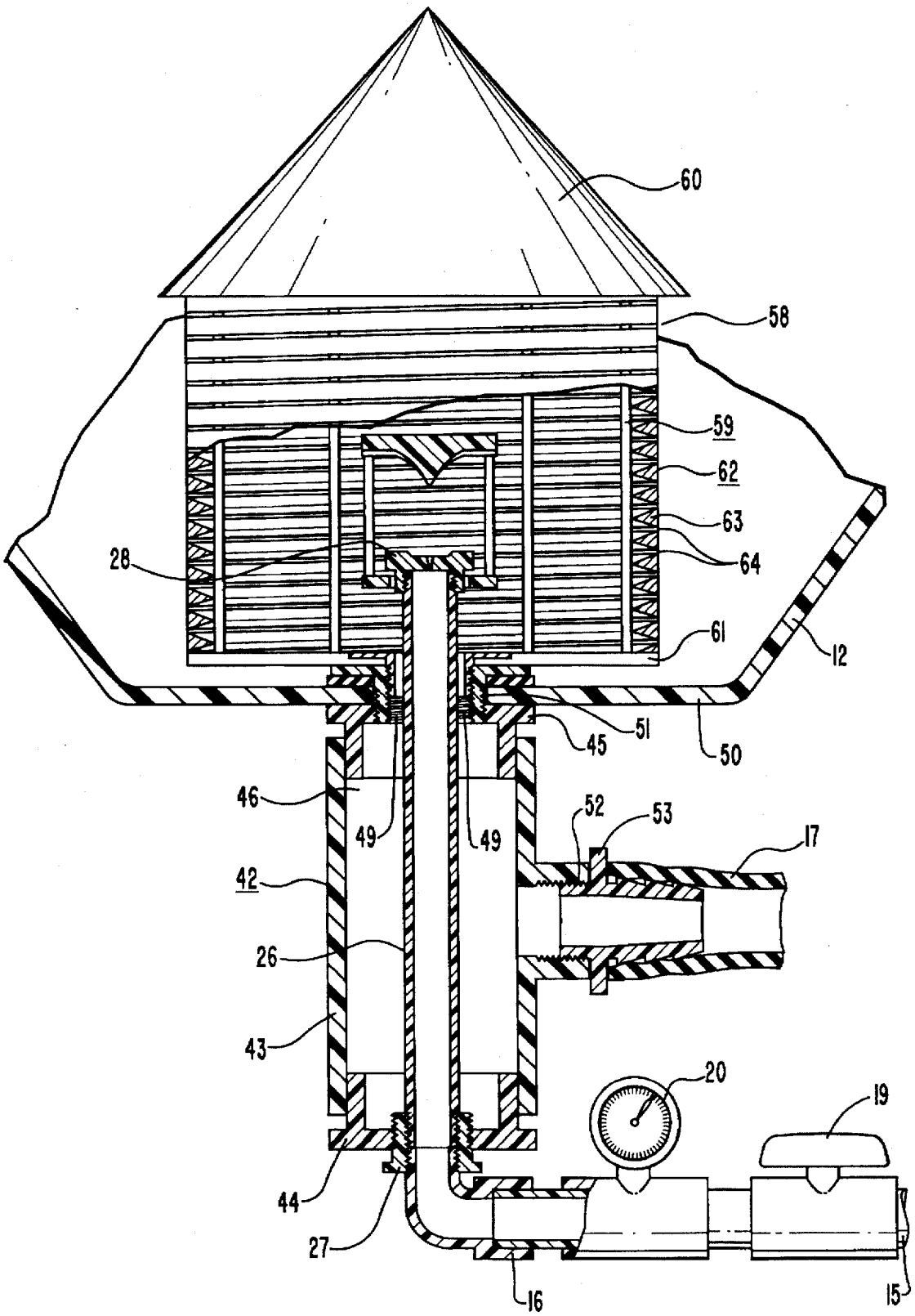

FIG. 9 is another embodiment of the invention.

Note that while the invention has been and will be described in terms of aqueous mixtures of selected soil amendments, for example, for irrigation systems, in broadest terms the invention comprises an apparatus and method for mixing any desired powderous substance with and into a spray liquid. Thus, and by way of additional example, the invention might be used for introducing finely powdered sodium hypochlorite into sewage effluent so as to chlorinate the effluent. Other uses may suggest themselves when considering the basic features of the invention.

DESCRIPTION OF PREFERRED EMBODIMENTS

Figure 1:
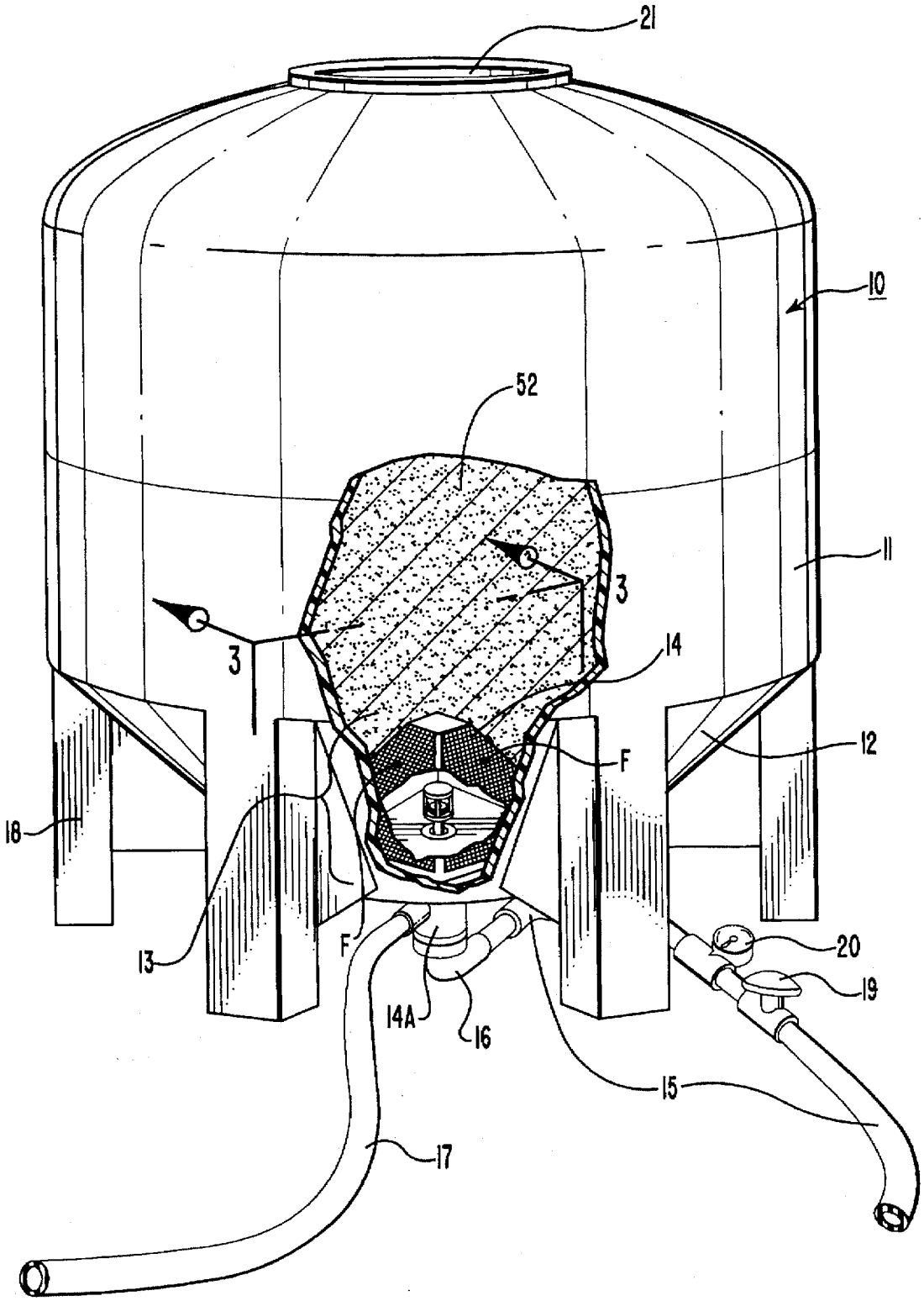
FIG. 1 is a side elevation of structure incorporating essential features of the present invention.

In FIG. 1 container 10 includes an upper portion 11. Upper portion 11 is regular in configuration and contains a large quantity of soil amendment such as a high-purity, powdered gypsum additive. Lower portion 12 shown to comprise a gravity-feed truncated cone having mixing zone 13 comprised of mixing zone structure 14. To the mixing zone structure 14 will be coupled a water inlet conduit 15, provided with inlet conduit connection 16. From the mixing zone structure 14 at 14A, there will be coupled an outlet conduit 17, otherwise known as a slurry outlet conduit, which leads to an irrigation system to be accommodated by the slurry that is provided. For support purposes legs 18 will be provided the container 10 and oriented generally in the positions indicated.

Inlet conduit 15 is provided a hand-operated pressure regulator 19, by way of example, regulating the water pressure leading into mixing zone of the unit. Pressure gauge 20 can be included in the line for giving visual indication as to the actual water pressure being employed in the system.

Admittance port 21 is an opening for receiving the soil amendment such as powdered gypsum.

Figure 2:
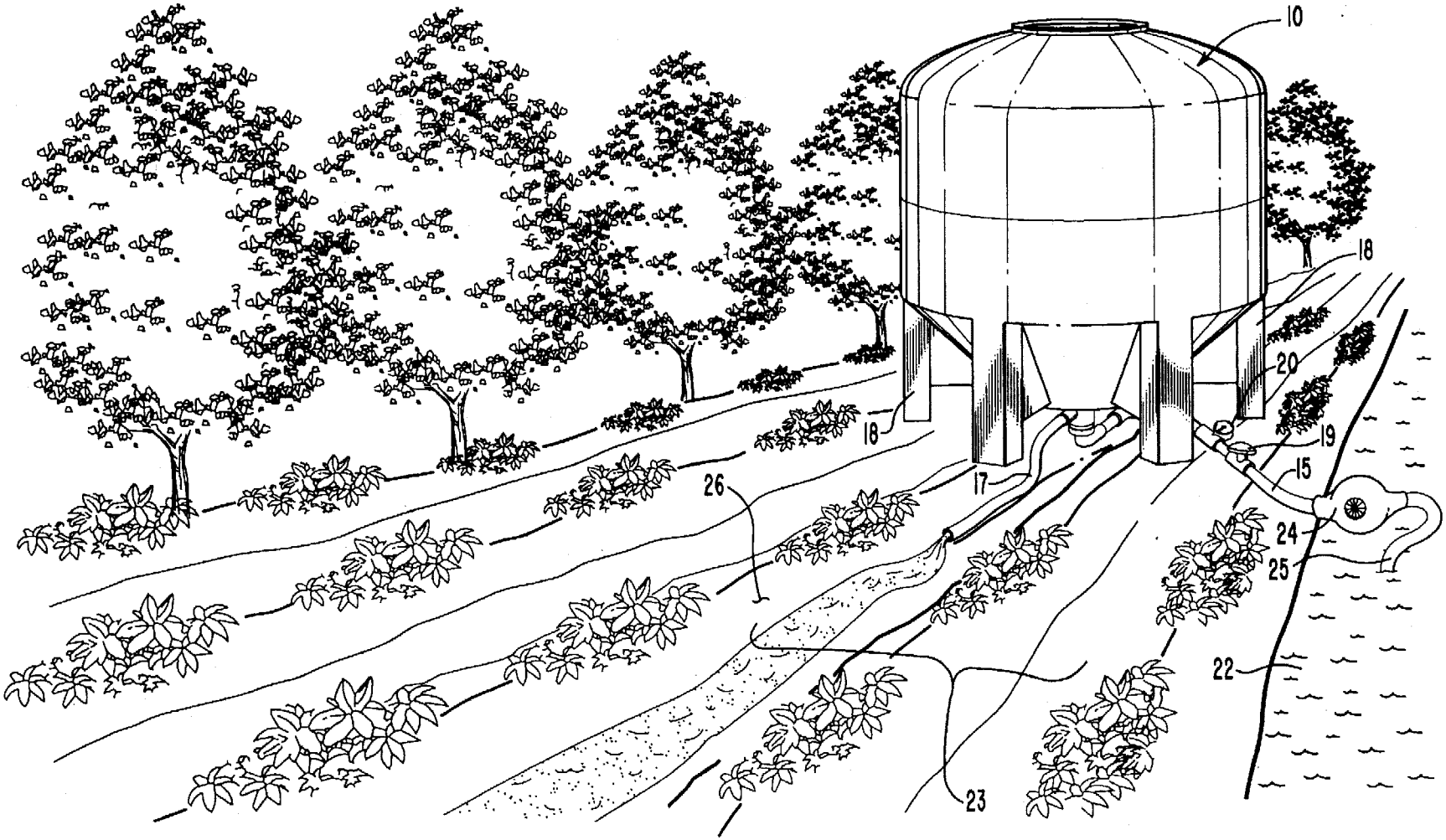
FIG. 2 is a perspective view, showing one manner in which the structure of FIG. 1 is used to supply an aqueous slurry addition to irrigation water.

In FIG. 2 irrigation canal 22 is shown adjacent to a field or plot 23 to be irrigated and, in such event, the inlet conduit 15 supplied with an electrically driven or another type suction pump 24, the same having an inlet conduit 25 disposed in the irrigation canal 22. Again, container 10 at its lower zone will supply a slurry at 17 to be introduced over or into a furrow or ditch, and thereat can be mixed with incoming water, not shown, in the ditch that is supplied by the irrigation canal 22 in any conventional manner. Of course, the outlet conduit 17 can be coupled to any irrigation system desired or present. Again, it is to be emphasized that the slurry is either supplied per se as a soil dressing or amendment, or the slurry is mixed into a running water stream or flow that is provided for irrigation purposes.

In FIGS. 3 and 4, inlet conduit connector 16, coupled to inlet conduit 15, is connected to upstanding conduit riser 26. Combination attachment plug and connector 27 forms a junction and the ends of member 16, 26 are threaded as indicated to receive the interior threads of connector 27. Conduit riser 26 is provided with a spray jet head 28 that is threaded thereon. Disposed over and secured in loose fashion to head 28 is a spray deflector unit 29 comprising a top 30, a base 31, and plural mutually spaced connecting posts 35 which are secured to and between the top 30 and base 31.

The underside of top 30 has a central depending apex 32 provided with a series of outwardly extending channels 33 for conducting desired water streams in an appropriate manner. In operation, the wobbling-nature of spray deflector unit 29 is produced through the impingement upon apex 32 of the water spray proceeding upwardly from spray jet head 28, and serves to vary the multiple spray directions proceeding from mixing zone structure 14 such that water spray impinge upon essentially the entire interior surface area of screen 34, which is now about to be described.

Included within lower zone 13, and in fact defining the same, is a screen structure 36 that comprises a top 37, a base 38, and support screen 39. Support screen 39 can be made from perforate, expanded metal stock or other type of perforate, essentially rigid material. The screen structure can be of conical nature or simply triangularly shaped having a series of faces as seen at F in FIG. 1. Upper and lower end margins 40 and 41 are respectively secured to top 37 and base 38 in the manner indicated.

The outer screen 39 protects an inner screen mesh 34, likewise disposed between top 37 and base 38. This inner screen, for gypsum use, is preferably of the order of a 200-mesh screen. The purpose for the inner screen is to accept powdered particulates of the soil amendment, such as gypsum, as pass through the perforations of the expanded metal outer screen 39, and then, by so doing, supply the powdered material to the water spray produced by a spray jet head 28 and wobble-type spray deflector unit 29, thereby causing an immediate introduction of the powdered amendment into the water spray sweeping over the interior surface of screen 34, such that the same produces a slurry-type flow proceeding downwardly in the direction of arrows A in FIG. 3.

In returning to FIG. 3 it is seen that conduit riser 26 is surrounded by a slurry container 42 formed in part by slurry container jacket sleeve 43, also upper and lower closure members 44, 45. The outer surface of riser 26 forms the interior boundary surrounding space 26 that comprises a slurry reservoir 46. Gasket 47 and collecting structure 48 are so constructed that annular passageway 49 is formed to conduct the dropping water-powder slurry mixture into reservoir 46.

Base 50 of lower portion 12 of the container 10 has a base aperture 51 accommodating both connection and passage of the several central parts as indicated in FIG. 3. Gasket 47 assures the water tight construction.

Slurry reservoir 46 provided with an outlet port 53A supplied with fitting 53 therein. Thus, the fitting 53 facilitates the connection of outlet conduit 17 conducting the slurry to a desired irrigation system or irrigation point.

The operation of the invention is as follows. A desired soil amendment such as powdered gypsum, is poured into admittance port 21 such that the same surrounds mixing zone 13 which is defined by screens 34 and 39. Water under desired pressure is introduced into inlet conduit 15, the applied pressure being selected or regulated by adjustable pressure regulator 19. This produces an inlet water stream, under desired pressure, which rises in riser conduit 26 to spray jet head 28. The spray supply, as seen in FIG. 4, actuates and in effect, produces a wobble in structure 29 such that the spray is widely dispersed over essentially the entire area of the inside fine mesh screen 34.

The finely powdered soil amendment at 52 proceeds through the interstices or apertures of the expanded metal outer screen, for example at 39, such that the powderous amendment substance appears and indeed commences passage through the apertures of the inner screen 34. The water spray produced sweeps across the interior area of the inner screen to draw progressive layers of powdered particulates through the screen so that, and without agitators or stirrers or other structure, there is hydraulically produced a highly efficient mixing of the water spray and the powderous amendment substance appearing at the inner surface of the inner screen. This mixture washes down as a slurry to approach annular passageway 49 in the direction of arrows A, passing through such annular passageway into reservoir area 46. Then the fluid-particulates mixture rises to the level of outlet conduit 17, see FIGS. 3 and 4, when it passes outwardly through outlet conduit 17 for immediate use as an additive to a water stream, as flows to a ditch, piping, and so forth, or is available immediately for desired introduction into selected furrows, ditches, or other areas of farmland or irrigation systems.

The slurry produced through outlet conduit 17, in fact, is so efficient and uniform in consistency that the same, upon the introduction into a larger water flow, will immediately widely disperse throughout the water medium present. Thus, the system avoids congealing of particulates, likewise eliminates the otherwise necessary usage of rapidly actuated stirrers, actuators and the like.

It has been found through experimentation that powderous uncalcined gypsum, 95% of which will pass a 200 mesh screen, is highly suitable for providing a highly efficient mixture or slurry, wherein the gypsum particulates are not merely suspended but actually dissolved in the aqueous solution generated.

Optional perforated baffle structures to the baffle, e.g., taking the form of screen structure 36, are seen in FIGS. 5–7, respectively. In FIG. 5 the screen structure is modified to include a perforate, preferably expanded metal screen 39A interiorly supporting the intermediate nylon, e.g., mesh screen 34, whereby to ensure against screen failure. In FIG. 6 the screen structure is replaced a solid, truncated cone 54 having mutually spaced wall slits 55 of approximately 0.005–0.010" width. The cone 54 of FIG. 6 can be replaced simply by a tubular member or cylinder, see FIG. 7, having a capped upper end and provided with mutual spaced sidewall slits 57, each being of, say, 0.005–2010" respective widths. Of course, disposed with the respective structures in FIGS. 5–7 will be the upper portion of riser 26, the structure 29, and so forth, see FIGS. 3–4.

What the invention provides, therefore, are an apparatus and method for producing a slurry of uniform consistency incorporating the concept of spraying the interior of a perforate screen to capture particulates present at the interior surface thereof, this for providing a descending mixture flow subsequent processing and/or usage.

The method, see FIG. 8, thus inherent in structure above described and its hydraulic operation comprises:

Providing a container containing powdered, particulates;

Providing a mixing zone at a lower portion of said container by perforate barrier, baffle, sieve, or screen structure communicating with particulates in said container;

Spraying with liquid the interior of said structure to capture progressively said particulates as progressively appear at and pass through said barrier;

Collecting the mixture formed by such liquid and said particulates resulting from the next above spray step, and Introducing the slurry produced into a desired system.

In FIG. 9 the perforate baffle structure takes the form of structure 58 which comprises an inner frame 59, secured to and between top 60 and base 61. Frame 59 takes the form of a spindle and has, helically wrapped thereabout and secured thereto as by spot welding, a wire 62 the adjacent turns 63 of which are spaced between 0.005–0.010". The elemental cross-section of the wire is preferably triangular as indicated, being tapered inwardly so as to provide a helically formed orifice 64, tapered outwardly as shown.

In operation, the liquid spray proceeds out of helical orifice 64, collects the particulates and returns back through orifice 64 to be washed down the inner side of 59, by the spray from the spray head 28, into passageways 49.

While particular embodiments of the present invention have been shows and described, it will be obvious to those skilled in the art that various changes and modifications may be made without departing from the essential aspects of the invention and, therefore, the aim in the appended claims is to cover such changes and modifications as fall within the true spirit and scope of the invention.

I claim:

1. Apparatus for effecting the spray-capture of particulate present for passing through a perforate baffle having multitudinous perforations, including, in combination: a container having an essentially horizontal base provided with an aperture defined by a peripheral base edge; a perforate baffle disposed proximate to and extending above said base and having a first, particulate' source side and a second, spray-receiving side; an upstanding liquid-delivery conduit riser passing through said aperture, transversely peripherally spaced from said peripheral edge defining said aperture whereby to provided a slurry-flow annular passageway, and extending both above and beneath said container base; sprayer means disposed above said base and coupled to said upstanding conduit riser for sweeping a water spray across said spray-receiving side, whereby to produce a liquid-particulate slurry; slurry receiving reservoir structure secured to and beneath said base and also to said upstanding conduit and forming with the exterior of said conduit riser a reservoir area communicating through said annular passageway with said container above said base and beneath said baffle; means for pumping pressured liquid supply coupled to said sprayer means, and an outlet conduit coupled to said reservoir structure for conducting said slurry to a desired location.

2. The apparatus of claim 1 wherein said sprayer means comprises a spray head coupled to and above said riser, and a wobble spray-deflector device mounted over said conduit riser and operatively disposed over said spray head.

3. In combination, a container having a base provided with an access aperture, perforate structure having an upper surface and disposed within said container above said aperture, a fluid riser spacedly disposed within and extending through said aperture and having a spray-type sprinkler head positioned above said base and beneath said perforate structure, reservoir structure axially surrounding said riser and secured to said riser and base, and outlet conduit secured to said reservoir structure, said container comprising means for delivering powdered particulate to said upper surface of said perforate structure.

4. The combination of claim 3 wherein said structure comprises a frame, and a spiraled element helically wound over and secured to said frame such that adjacent turns of said element are spaced apart a distance of the order of 0.005–0.010", interstices between said turns comprising a helical, liquid jet orifice.

* * * * *